US007222508B2

(12) United States Patent
Dickhans et al.

(10) Patent No.: US 7,222,508 B2
(45) Date of Patent: May 29, 2007

(54) DOOR LOCK UNLOCKABLE TWO WAYS

(75) Inventors: William J. Dickhans, Colorado Springs, CO (US); Brian K. Roth, Elbert, CO (US)

(73) Assignee: Schlage Lock Company, Indianapolis, IN (US)

( * ) Notice: Subject to any disclaimer, the term of this patent is extended or adjusted under 35 U.S.C. 154(b) by 13 days.

(21) Appl. No.: 10/991,276

(22) Filed: Nov. 17, 2004

(65) Prior Publication Data

US 2006/0101878 A1 May 18, 2006

(51) Int. Cl.
*E05B 47/06* (2006.01)

(52) U.S. Cl. ..... 70/279.1; 70/278.3; 70/278.7

(58) Field of Classification Search ..... 70/279.1, 70/188, 189, 222, 381, 252, 283, 278.3, 278.7
See application file for complete search history.

(56) References Cited

U.S. PATENT DOCUMENTS

| | | | | |
|---|---|---|---|---|
| 3,200,623 | A | 8/1965 | Peters | |
| 3,241,344 | A | 3/1966 | Peters | |
| 4,099,752 | A | 7/1978 | Geringer | |
| 4,426,864 | A | 1/1984 | Morikawa | |
| 4,438,962 | A | 3/1984 | Soloviff et al. | |
| 4,677,834 | A | 7/1987 | Hicks | |
| 4,716,748 | A * | 1/1988 | Watanuki et al. | 70/252 |
| 4,747,280 | A | 5/1988 | Shaw | |
| 4,854,143 | A * | 8/1989 | Corder et al. | 70/218 |
| 4,936,122 | A | 6/1990 | Osada | |
| 5,016,455 | A * | 5/1991 | Hennessy | 70/493 |
| 5,018,375 | A | 5/1991 | Tully | |
| 5,040,390 | A * | 8/1991 | Mistry et al. | 70/241 |
| 5,079,936 | A * | 1/1992 | Stefanek | 70/358 |
| 5,113,675 | A | 5/1992 | Uyeda | |
| 5,148,691 | A | 9/1992 | Walldén | |
| 5,335,950 | A | 8/1994 | Mirshafiee et al. | |
| 5,404,737 | A | 4/1995 | Hötzl | |
| 5,542,274 | A | 8/1996 | Thordmark et al. | |
| 5,552,777 | A | 9/1996 | Gokcebay et al. | |
| 5,816,085 | A | 10/1998 | Winardi et al. | |
| 5,857,365 | A | 1/1999 | Armstrong | |
| 5,960,656 | A | 10/1999 | Yao | |
| 5,974,912 | A | 11/1999 | Cheng et al. | |
| 6,012,310 | A | 1/2000 | Hsiao | |
| 6,038,896 | A | 3/2000 | Chamberlain et al. | |
| 6,412,318 | B1 | 7/2002 | Shen | |
| 6,418,764 | B1 | 7/2002 | Lerchner | |
| 6,419,288 | B1 | 7/2002 | Wheatland | |
| 6,474,122 | B2 | 11/2002 | Davis | |
| 6,564,601 | B2 | 5/2003 | Hyatt Jr. | |
| 6,598,909 | B2 | 7/2003 | Lu | |
| 6,651,468 | B2 | 11/2003 | Aramburu et al. | |
| 6,904,777 | B2 * | 6/2005 | Kehr | 70/252 |
| 2003/0136162 | A1 | 7/2003 | Sutton et al. | |

* cited by examiner

*Primary Examiner*—Lloyd A. Gall
(74) *Attorney, Agent, or Firm*—Michael Best & Friedrich LLP

(57) ABSTRACT

A door lock includes a housing suitable for secure attachment to a door, a cylinder body within the housing and selectively rotatable with respect to the housing, and a rotating member with a key receptacle selectively rotatable with respect to the cylinder body. The rotating member is coupled to a tailpiece. A first locking device allows the rotation of the cylinder body with respect to the housing upon the presentation of an appropriate electronic credential, and a second locking device allows rotation of the rotating member together with the tailpiece with respect to the cylinder body upon the insertion of an appropriate key in the key receptacle.

30 Claims, 8 Drawing Sheets

Fig. 7
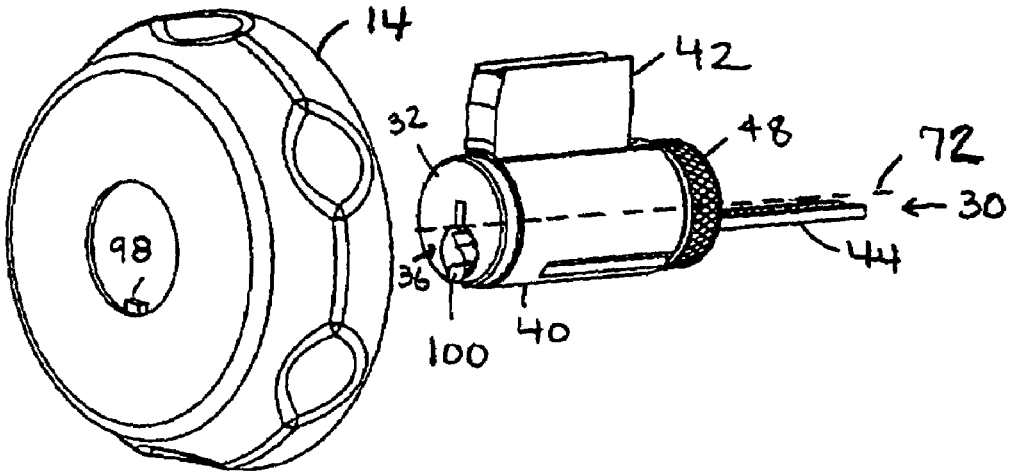
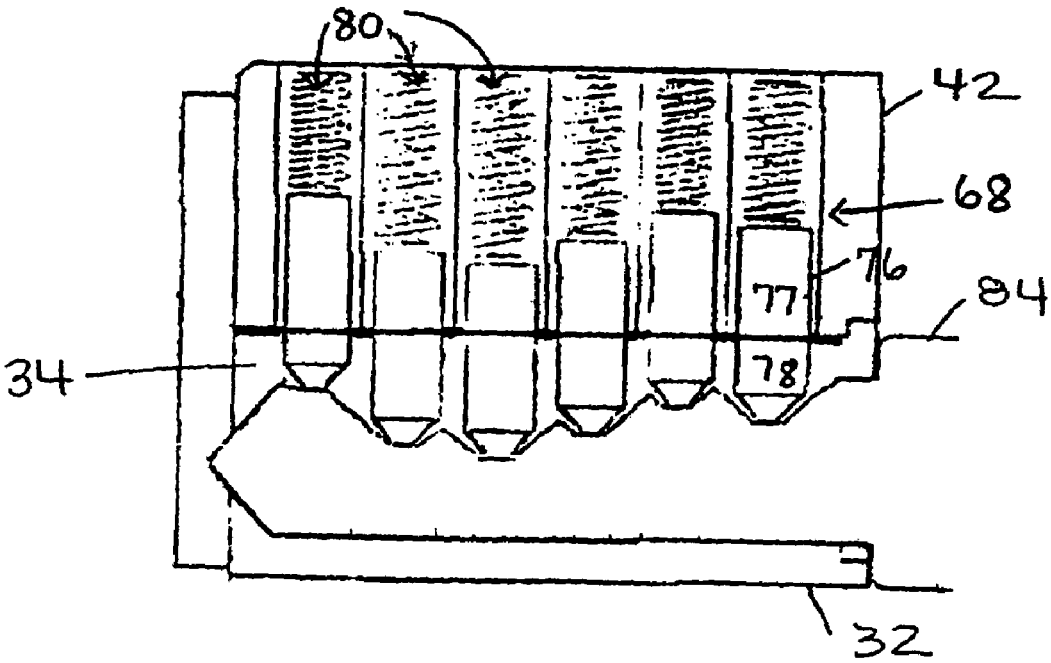
Fig. 8

DOOR LOCK UNLOCKABLE TWO WAYS

FIELD OF THE INVENTION

The present invention relates generally to a door lock that can be unlocked either electromechanically by the presentation of an electronic credential or mechanically using an appropriate key.

BACKGROUND OF THE INVENTION

Various prior art locks exist that can be opened in two ways. For example, U.S. Pat. Nos. 3,241,344; 5,148,691 and 6,012,310 describe locks that are capable of being opened either using a key or in a keyless manner.

One keyless manner to open a lock is via the presentation of an electronic credential. For example, providing a lock that can be unlocked by entering an appropriate key code allows a door to be unlocked by individuals having knowledge of the key code without having to provide keys to all such individuals. Providing a lock that can be opened either using a key or upon the presentation of an appropriate electronic credential can be advantageous in that the lock may still be unlockable even in the event of a power failure.

SUMMARY OF THE INVENTION

The present invention provides a door lock that is simple to manufacture and construct, and is unlockable in the event of a power failure. In one embodiment, the door lock allows an individual to use the same motion to simply rotate a turnpiece to open the door after inserting an appropriate key or upon the presentation of an appropriate electronic credential. This provides simplicity for an individual in that no axial movement is required along with the rotation of the turnpiece in order to open the door.

The invention provides a door lock that is operable to rotate a tailpiece between two positions including a first locked position and a second unlocked position. The tailpiece can be coupled to a latch to move it between a locked and an unlocked position. The tailpiece can also interact with a device that translates the rotative motion of the tailpiece to linear motion in order to move a latch such as a deadbolt between a locked position and an unlocked position.

The door lock includes a housing suitable for secure attachment to a door. The lock includes a cylinder body located at least partially within the housing and selectively rotatable with respect to the housing, and a rotating member located at least partially within the cylinder body and selectively rotatable with respect to the cylinder body. The rotating member includes a key receptacle. A tailpiece is coupled to the rotating member and configured to selectively rotate with the rotating of the rotating member. A first locking device prevents rotation of the cylinder body with respect to the housing in the absence of an appropriate electronic credential, and allows the rotation with respect to the housing of the cylinder body together with the rotating member and tailpiece upon the presentation of an appropriate electronic credential and in the absence of an appropriate key. A second locking device prevents rotation of the rotating member with respect to the cylinder body in the absence of an appropriate key, and allows rotation of the rotating member and tailpiece with respect to the cylinder body when an appropriate key is inserted in the key receptacle.

Other features and advantages of the invention will become apparent to those skilled in the art upon review of the following detailed description, claims, and drawings.

BRIEF DESCRIPTION OF THE DRAWINGS

FIG. 7 is a perspective view of a rotating member within a cylinder body according to a first embodiment and shows a turnpiece that is engageable with the rotating member such that the turnpiece can be rotated to rotate the rotating member under specific conditions;

FIG. 8 illustrates an example of a second locking device when an appropriate key has been inserted into the key receptacle.

DETAILED DESCRIPTION OF THE PREFERED EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The order of limitations specified in any method claims does not imply that the steps or acts set forth therein must be performed in that order, unless an order is explicitly set forth in the specification.

Figure 1:
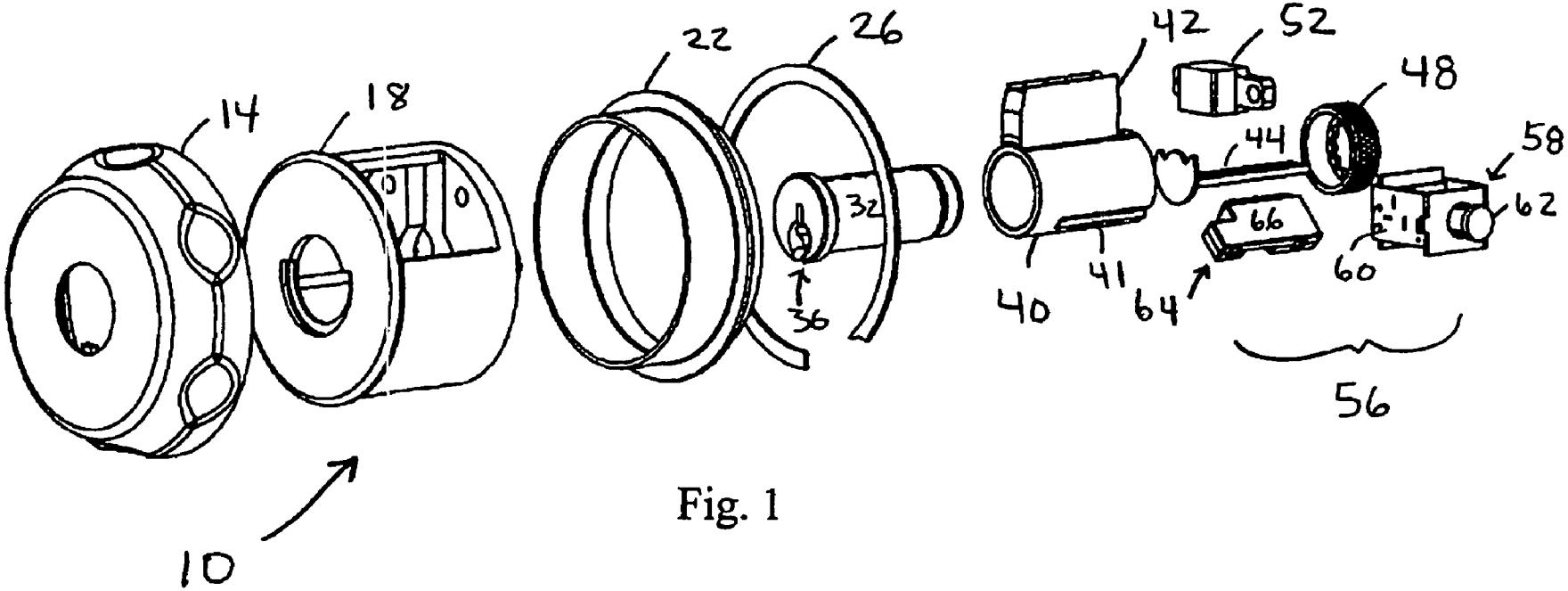
FIG. 1 is an exploded view of the components of the lock according to a first embodiment.
Figure 2:
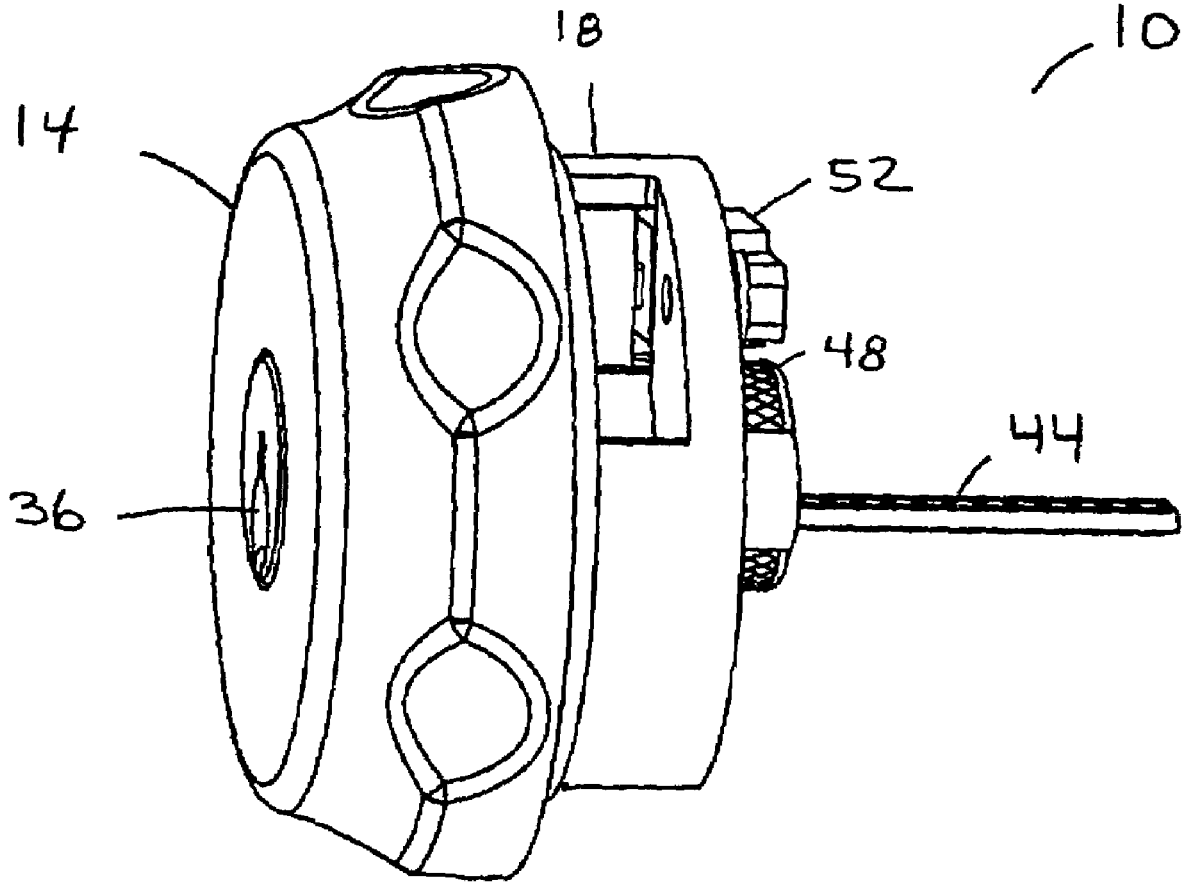
FIG. 2 is an illustration of the assembled lock of FIG. 1 (not showing the locking devices)

FIG. 1 illustrates an exploded view of the components of a door lock 10 according to one embodiment of the invention, and FIG. 2 illustrates the assembled door lock 10. In particular, door lock 10 includes a turnpiece 14 for rotating a rotating member 32, and a housing 18 that is configured to be securely attached to a door and includes a sleeve 22 and a retaining ring 26. In one embodiment, the rotating member 32 is generally cylindrical and includes a key receptacle 36. A cylinder cap 48 couples the rotating member 32 to a tailpiece 44. When assembled, part of the rotating member 32 is located within a cylinder body 40 and a cylinder blocker 52 operates to restrict the axial movement of the cylinder body 40. The door lock 10 includes a first locking device 56 including an electronic device 58 for receiving an electronic credential and controlling a locking member 64 such as sidebar 66. The door lock also includes a second locking device 68 for receiving a key. The second locking device 68 interacts with the rotating member 32 and the cylinder body 40, and is not specifically shown in FIG. 1, but is illustrated in FIG. 8.

Figure 3A:
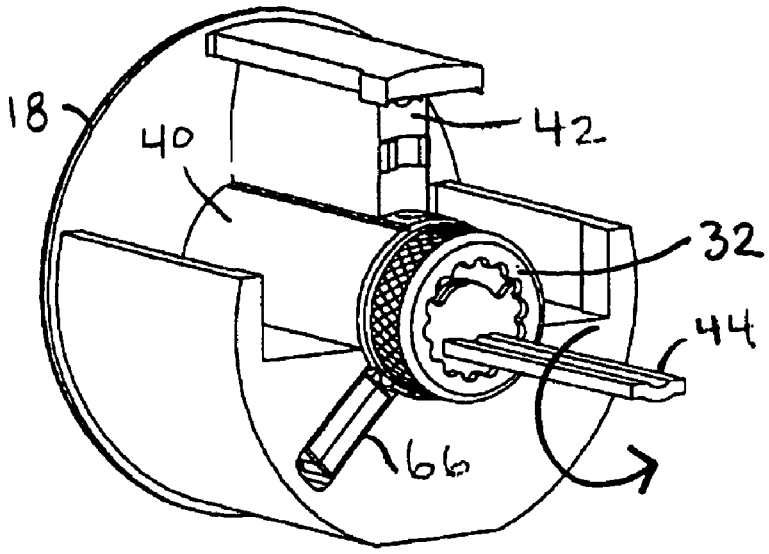
FIGS. 3(*a*) and 3(*b*) are perspective views of the tailpiece in respective locked and unlocked positions wherein the cylinder body together with the rotating member has been rotated with respect to the housing (partially removed) from the first view to the second view.
Figure 3B:
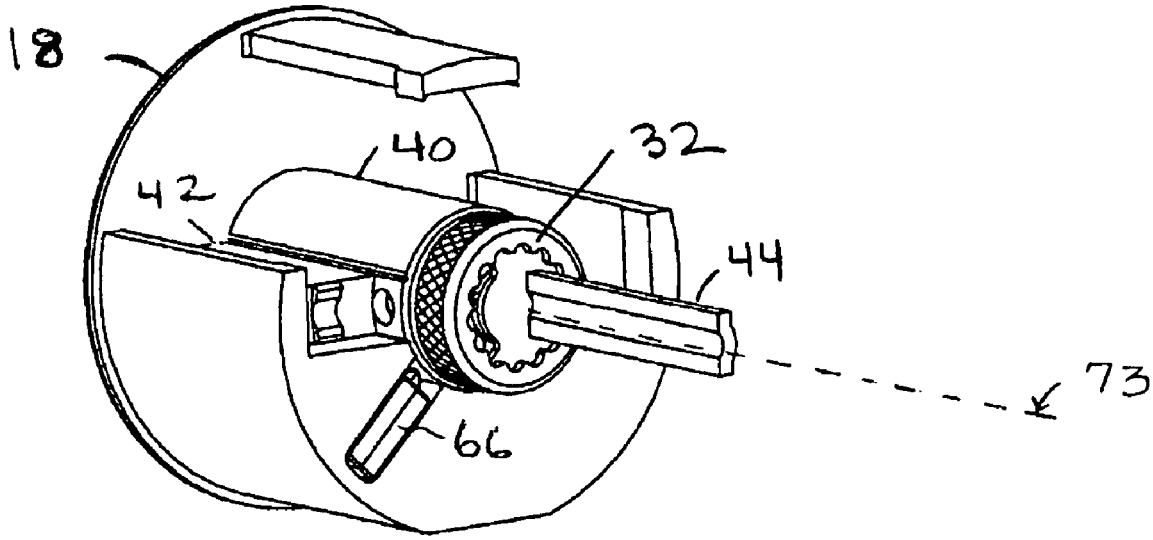

The following is a general overview of the operation of such a lock. As more fully described below, the tailpiece 44 is configured to be rotated with respect to the housing 18 between two positions. A first locked position of tailpiece 44 is illustrated in FIG. 3(*a*), and a second unlocked position of tailpiece 44 is illustrated in FIG. 3(*b*). As described below with respect to FIG. 9, the tailpiece 44 is configured to selectively rotate with the rotation of the rotating member.

The rotating member 32 together with the tailpiece 44 can be rotated upon the presentation of an appropriate electronic credential, such as a signal developed upon entering a code or presenting a key card, to the first locking device 56. The rotating member together with the tailpiece 44 can also be rotated upon the insertion of an appropriate key into the key receptacle 36, which unlocks the second locking device 68.

The tailpiece 44 is adapted to interact with a device, such as a cam or the like, that translates the rotative motion of the tailpiece 44 to linear motion to move a deadbolt in and out of engagement with a doorframe in order to lock and unlock a door. Alternately, the tailpiece 44 can be coupled to a latch that rotates with the tailpiece to engage with the door frame and lock the door as the tailpiece is moved to its locked position. Such translating devices, deadbolts, and latches are known in the art, and are not illustrated herein.

In particular, FIG. 7 illustrates a partially assembled lock including rotating member 32 that is located partially within cylinder body 40 and is selectively rotatable with respect to the cylinder body 40 around an axis of rotation 72. As mentioned, rotating member 32 in one embodiment is coupled to tailpiece 44 by the cylinder cap 48.

Cylinder body 40 includes portion 42 for partially housing the second locking device 68, which is illustrated in FIG. 8. Second locking device 68 is known in the art, and comprises, for example, a set of pin pairs 76 biased with springs 80, with each pair located partially within the cylinder body portion 42 and partially in a groove 34 in the rotating member 32. Portion 42 acts as a pin constraining portion, such that in the absence of an appropriate key, the pin pairs extending between the portion 42 and rotating member 32 prevent the rotating member from being rotated with respect to the cylinder body 40. In the absence of an appropriate key, the second locking device is in a locked position. When an appropriate key 84 is inserted into the key receptacle 36, as illustrated in FIG. 8, the key pattern moves the pin pairs 76 to appropriate locations such that the rotating member 32 can then be rotated with respect to the cylinder body 40 by turning the key 84. In particular, for each pin pair 76 having a first pin 77 and a second pin 78, when an appropriate key 84 is inserted in the key receptacle, the boundary between the first pin 77 and the second pin 78 is aligned with the boundary between the rotating member 32 and the cylinder body 40. By rotating the key 84, the first pin 77 and second pin 78 can be moved with respect to each other and allow the rotating member 32 to be rotated with respect to the cylinder body 40.

FIGS. 3(*a*) and 3(*b*) are perspective views of the door lock 10 illustrating the arrangement of the rotating member 32 with respect to the cylinder body 40 and the arrangement of the cylinder body 40 with respect to the housing 18 (partially removed). In particular, in one embodiment, the cylinder body 40 is located within the housing 18, and is selectively rotatable with respect to the housing 18. FIGS. 3(*a*) and 3(*b*) partially show the sidebar 66 of the first locking device 56.

Figure 5A:
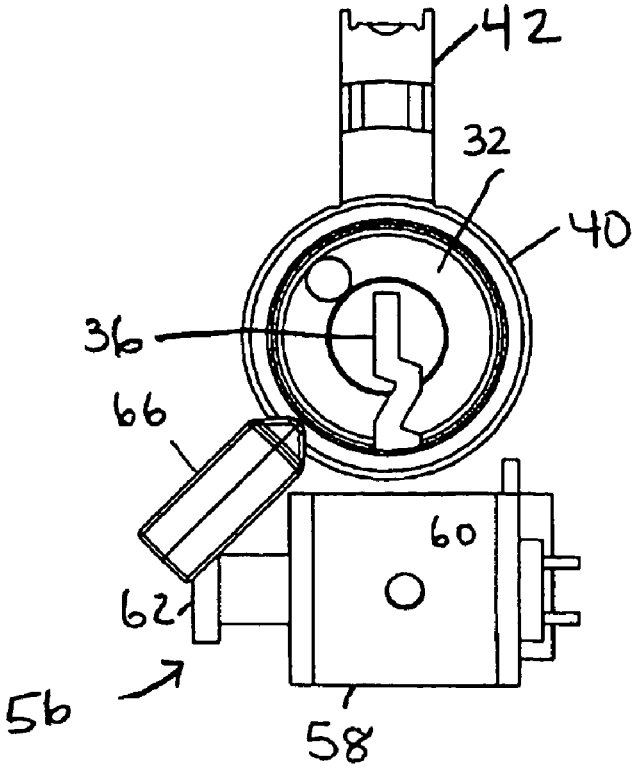
FIGS. 5(*a*) and 5(*b*) are schematic front views of the lock showing one example of a first locking device.
Figure 5B:
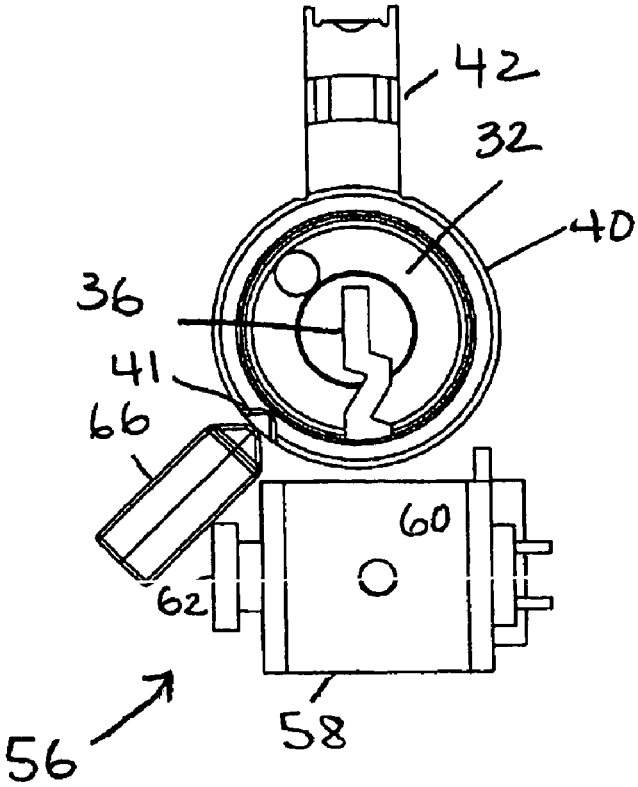
Figure 6A:
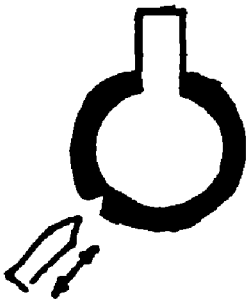
FIGS. 6(*a*)-6(*h*) illustrate other examples of a first locking device.
Figure 6B:
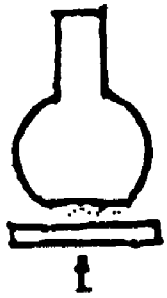
Figure 6C:
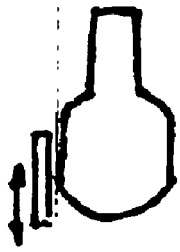
Figure 6D:
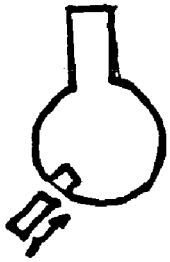
Figure 6E:
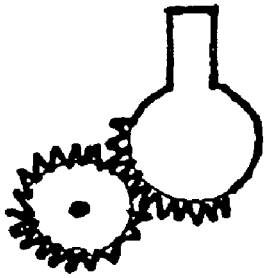
Figure 6F:
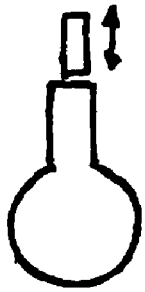
Figure 6G:
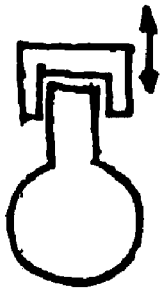
Figure 6H:
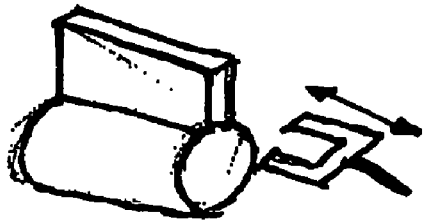

One construction of the first locking device 56 is illustrated in FIGS. 5(*a*) and 5(*b*), which are schematic front views of the door lock 10 corresponding to the views of FIGS. 3(*a*) and 3(*b*) respectively. The first locking device 56 prevents rotation of the cylinder body 40 with respect to the housing 18 in the absence of an appropriate electronic credential. In the absence of an appropriate electronic credential, the first locking device 56 is in a locked position. The first locking device 56, upon the presentation of an appropriate electronic credential, allows the rotation of the cylinder body 40 with respect to the housing 18.

In particular, in one embodiment, first locking device 56 comprises electronic device 58 that is reactive to the presentation of an appropriate electronic credential and a locking member 64 such as sidebar 66. The locking member 64 is movable between a first position and a second position. The first position, wherein the locking member 64 is engaged in a groove 41 in the cylinder body 40, is illustrated in FIG. 5(*a*), and the second position, wherein the locking member 64 is not engaged with the cylinder body 40, is illustrated in FIG. 5(*b*). At the first position, the locking member 64 prevents rotation of the cylinder body 40 with respect to the housing 18 and at the second position, the locking member 64 allows the cylinder body to be rotated with respect to the housing. The electronic device 58 includes an actuator 60, such as a motor or a solenoid, and a pin 62 for either moving the locking member 64 or allowing locking member 64 to move from the first position to the second position upon the presentation of an appropriate electronic credential.

FIG. 3(*a*) therefore illustrates the situation wherein the tailpiece 44 is in its locked position, and the second locking device 68 (not shown) is locked to prevent rotation of the rotating member 32 with respect to the cylinder body 40, because an appropriate key is not present. Further, in FIG. 3(*a*), the first locking device is locked via sidebar 66. FIG. 3(*b*) illustrates the situation wherein the tailpiece 44 has been rotated to its unlocked position, because an appropriate electronic credential has been presented and has caused the sidebar 66 to be retracted which allows the cylinder body to be rotated with respect to the housing. More specifically, when an appropriate electronic credential is presented and in the absence of an appropriate key in the key receptacle 36, because the second locking device 68 remains locked, if the cylinder body and rotating member 32 are rotated in the direction of the arrow in FIG. 3(*a*), the tailpiece 44 is rotatable with the rotating member so is also rotated. The cylinder body 40 is rotatable about an axis of rotation 73.

Upon the presentation of an appropriate electronic credential and when the second locking device is locked, one way to rotate the cylinder body 40 and hence the rotating member 32 including tailpiece 44 is to use turnpiece 14. Referring to FIG. 7, turnpiece 14 can be engaged with the rotating member 32, and in one embodiment, turnpiece 14 includes a pin 98 that engages a notch 100 on the rotating member 32 such that rotating the turnpiece rotates the rotating member 32. A turnpiece could also be constructed to engage with the cylinder body 40 rather than the rotating member 32, and this would work to rotate the cylinder body together with the rotating member when the cylinder body is rotatable with respect to the housing but the second locking device is locked. However, such a construction would not work to rotate the rotating member with respect to the cylinder body in the event that the first locking device is locked and an appropriate key is inserted in the key receptacle 36. In that case, rotating the rotating member can occur only by turning the appropriate key in the cylinder body.

Figure 4A:
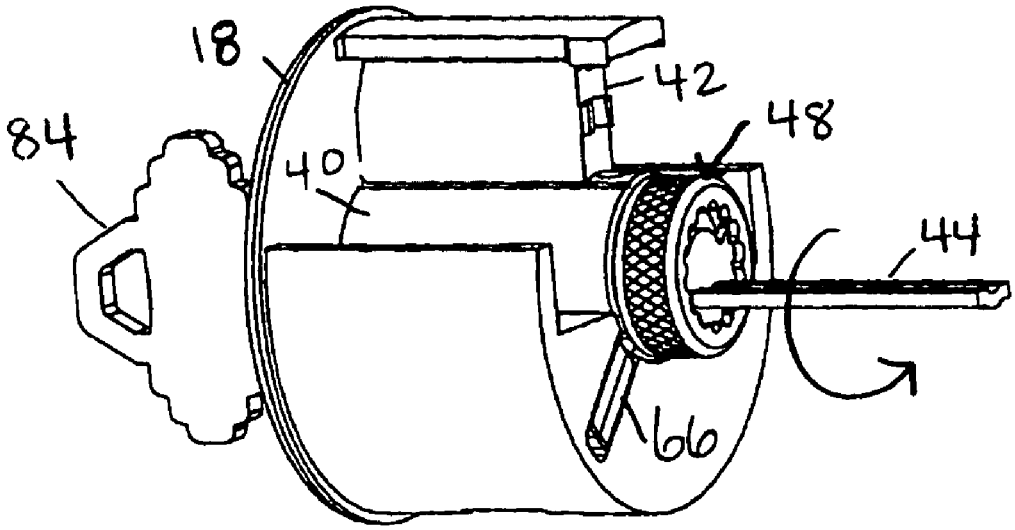
FIGS. 4(*a*) and 4(*b*) are two perspective views of the tailpiece in respective locked and unlocked positions wherein an appropriate key has been inserted and rotated such that the rotating member has been rotated with respect to the cylinder body from the first view to the second view.
Figure 4B:
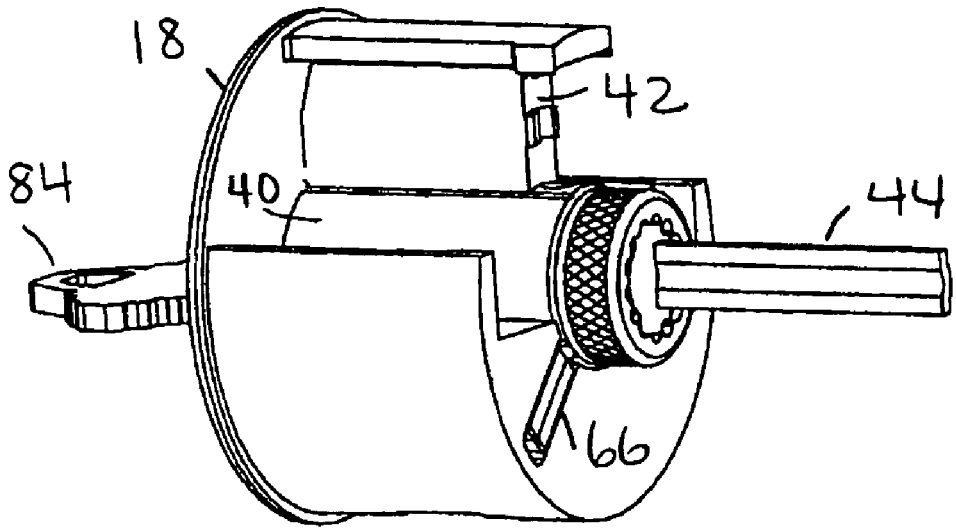

FIGS. 4(*a*) and 4(*b*) illustrate the situation wherein the first locking device is locked is via sidebar 66 to prevent rotation of the cylinder body 40 with respect to the housing 18. Inserting an appropriate key 84 in the key receptacle and rotating the key rotates the rotating member which allows the tailpiece 44 to be rotated from the locked position, shown in FIG. 4(*a*), to the unlocked position, shown in FIG. 4(*b*).

In the illustrated embodiment of the door lock, the axis of rotation 72 of the rotating member with respect to the cylinder body 40 is the same as the axis of rotation 73 of the cylinder body 40 with respect to the housing 18. However, the axes do not need to be the same, although they should be parallel to each other.

Figure 9A:
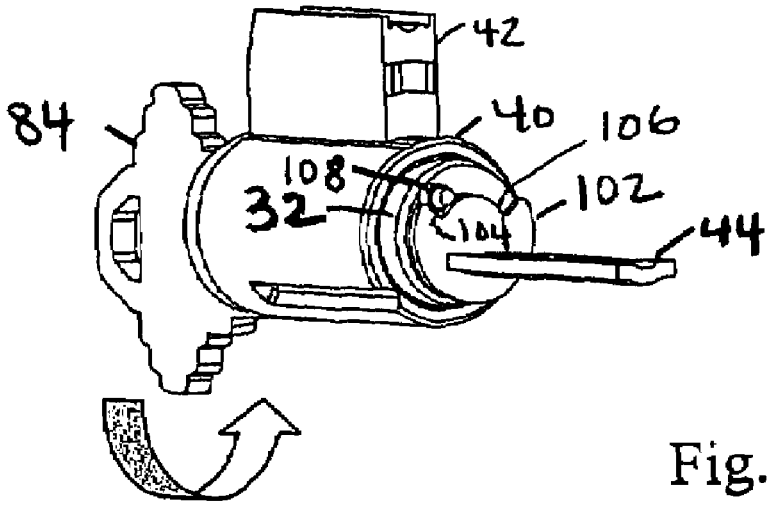
FIGS. 9(*a*)-9(*c*) illustrate how the tailpiece is configured to selectively rotate with the rotating member.
Figure 9B:
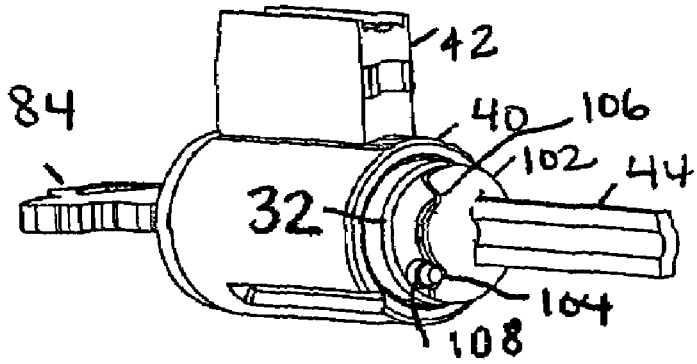
Figure 9C:
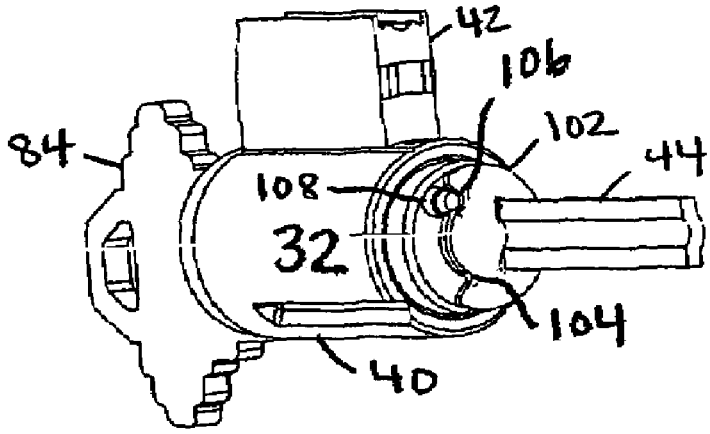

As previously mentioned, the tailpiece 44 is configured to selectively rotate with the rotation of rotating member 32. The selective rotation is necessary in order to withdraw the key 84 after either locking or unlocking a latch, for example, without having the latch move from either its locked or unlocked position. In particular, FIGS. 9(*a*)-(*c*) show a simplified tailpiece 44 and rotating member 32, but without cap 48. The tailpiece includes an end portion 102 having notches 104 and 106. Tailpiece 44 includes a pin 108. Specifically, FIG. 9(*a*) illustrates a position wherein the tailpiece 44 is in its locked position. When the appropriate key 84 is inserted and rotated in the direction indicated by the arrow in FIG. 9(*a*), the pin 108 engages with the notch 104 such that the tailpiece 44 is rotated with the rotating member 32. FIG. 9(*b*) then illustrates the tailpiece 44 in its unlocked position. Although not illustrated, the tailpiece is coupled to a latch that is moved from its locked to unlocked position as well. Because of the set of pin pairs comprising the second locking device, the key can only be removed when in its upright position. In order to then remove the key without re-locking the latch (without moving the tailpiece from its unlocked position), the key 84 is rotated from the position shown in FIG. 9(*b*) back to its upright position in the direction opposite the direction indicated by the arrow in FIG. 9(*a*). The position of the pin in FIG. 9(*b*) is such that when the key is rotated back to its upright position, the pin does not engage either notch in the end portion 102, and so the rotating member 32 rotates but the tailpiece 44 does not. Thus, as shown in FIG. 9(*c*), the key is in its upright position and can be removed, while the tailpiece stays in its unlocked position. Then starting from FIG. 9(*c*), inserting the key and rotating it in a direction opposite the direction indicated by the arrow in FIG. 9(*a*), causes pin 108 to engage with notch 106 such that the tailpiece 44 will be rotated with the rotation of the rotating member, and the tailpiece 44 can be rotated from an unlocked to a locked position. Similarly, then rotating the key back to the upright position does not move the tailpiece 44, so the key can be removed while the tailpiece remains locked.

FIG. 6 illustrates further examples of first locking devices that can be employed to selectively prevent and allow the rotation of the cylinder body with respect to the housing. In particular, FIG. 6(*a*) illustrates a locking member that engages a sleeve around the cylinder body, and when disengaged from the sleeve in response to an electronic device, allows the cylinder body to be rotated. FIGS. 6(*b*) and 6(*c*) illustrate a cylinder body having a flat surface, and a locking member that is movable to prevent and allow the cylinder body to be rotated. FIG. 6(*d*) illustrates a cylinder body and locking member having different shapes than the illustrated embodiment. FIG. 6(*e*) illustrates a cylinder body having a geared outer surface and a locking gear that is operable to prevent and allow rotation of the cylinder body. FIGS. 6(*f*) and 6(*g*) illustrate other examples of locking members for constraining the extended portion of the cylinder body. FIG. 6(*h*) illustrates that the cylinder body can also be prevented from rotating from an end (i.e., the back end opposite the key receptacle) rather than from the side.

In summary, the cylinder body 40 is rotatable with respect to the housing 18 when an appropriate electronic credential is presented, but the first locking device 56 prevents the rotation of the cylinder body 40 in the absence of an appropriate electronic credential. Additionally, rotating member 32 including tailpiece 44 is rotatable with respect to the cylinder body when an appropriate key is inserted into the key receptacle 36, but the second locking device 68 prevents the rotation of the rotating member 32 in the absence of an appropriate key. When an appropriate key is inserted and rotated, the tailpiece 44 is rotated with respect to the cylinder body 40. Upon the presentation of an appropriate electronic credential and in the absence of an appropriate key, the rotating member 32 and cylinder body 40 will rotate together with respect to the housing 18, so that a turnpiece 14 coupled to either the rotating member 32 or the cylinder body 40 can be used to rotate the tailpiece 44.

Various features and advantages of the invention are set forth in the following claims.

What is claimed is:

1. A door lock operable to rotate a tailpiece between two positions including a locked position and an unlocked position, the door lock comprising:

a housing suitable for secure attachment to a door and including an outer surface defining a cylinder, a cylinder body located at least partially within the housing and selectively rotatable with respect to the housing, a rotating member located at least partially within the cylinder body and selectively rotatable with respect to the cylinder body, the rotating member including a key receptacle, a tailpiece coupled to the rotating member and configured to selectively rotate with rotation of the rotating member, a turnpiece directly engaged with the rotating member and not directly engaged with the cylinder body, a first locking device that is mounted on the housing and completely within the cylinder defined by the outer surface and that prevents rotation of the cylinder body with respect to the housing in the absence of an appropriate electronic credential, and allows rotation of the cylinder body with respect to the housing upon the presentation of the appropriate electronic credential, a second locking device that prevents rotation of the rotating member with respect to the cylinder body in the absence of an appropriate key, and allows rotation of the rotating member with respect to the cylinder body upon the insertion of an appropriate key in the key receptacle, wherein when the appropriate key is inserted in the key receptacle and either the turnpiece or the key is turned, the tailpiece is rotated between the locked position and the unlocked position, and wherein upon the presentation of the appropriate electronic credential and in the absence of an appropriate key, when the turnpiece is rotated, causing the rotating member and the cylinder body to be rotated, the tailpiece is rotated between the locked position and the unlocked position.

2. The door lock of claim 1, wherein the cylinder body is rotatable about an axis of rotation that is the same as an axis of rotation of the rotating member.

3. The door lock of claim 2, wherein the axis of rotation defines an axial direction and the cylinder body is not movable in the axial direction.

4. The door lock of claim 2, wherein the axis of rotation defines an axial direction and the rotating member is not movable in the axial direction.

5. The door lock of claim 2, wherein the axis of rotation defines an axial direction and neither the rotating member nor the cylinder body is movable in the axial direction.

6. The door lock of claim 1, wherein the portion of the rotating member located within the cylinder body is generally cylindrical.

7. The door lock of claim 1, wherein the cylinder body is configured to partially house the second locking device 8. The door lock of claim 7, wherein the second locking device includes pin pairs extendable in a radial direction of the rotating member from a groove in the rotating member to a pin constraining portion of the cylinder body.

9. The door lock of claim 1, wherein the first locking device includes a locking member movable from a first position to a second position, wherein at the first position, the locking member prevents rotation of the cylinder body with respect to the housing and at the second position, the locking member allows rotation of the cylinder body with respect to the housing.

10. The door lock of claim 9, wherein the first locking device includes an electronic device reactive to the presentation of an appropriate electronic credential, wherein the electronic device includes an actuator for moving the locking member from the first position to the second position upon the presentation of an appropriate electronic credential.

11. The door lock of claim 10, wherein the locking member is engaged in a slot of the cylinder body in the first position and is disengaged from the slot in the second position.

12. The door lock of claim 11, wherein the locking member is moved outwardly in a radial direction from the slot to disengage the locking member.

13. The door lock of claim 1, wherein the first locking device includes a locking member and an electronic device reactive to the presentation of an appropriate electronic credential, and wherein the electronic device includes an actuator for moving the locking member upon the presentation of an appropriate electronic credential.

14. The door lock of claim 1, wherein the rotating member includes one of a notch and a pin, and the turnpiece includes the other of the notch and the pin, and wherein the pin is engaged with the notch.

15. The door lock of claim 14, wherein the engagement of the pin with the notch is configured to allow rotation of the rotating member with respect to the cylinder body in response to the insertion of the appropriate key into the key receptacle.

16. The door lock of claim 14, wherein the engagement of the pin with the notch is configured to allow rotation of the rotating member and the cylinder body with respect to the housing in response to the presentation of the appropriate electronic credential.

17. A door lock for rotating a tailpiece and suitable for interaction with a device that translates the rotative motion of the tailpiece to one of rotative motion or linear motion in order to move a latch between a locked position and an unlocked position, the door lock comprising:

a housing suitable for secure attachment to the door and including an outer surface defining a cylinder, a cylinder body located at least partially within the housing and selectively rotatable with respect to the housing around a first axis that defines an axial direction, a rotating member located at least partially within the cylinder body and selectively rotatable with respect to the cylinder body around a second axis that extends in the axial direction, the rotating member having a key receptacle, a tailpiece coupled to the rotating member and configured to selectively rotate with rotation of the rotating member, a turnpiece directly engaged with the rotating member and not directly engaged with the cylinder body, a first locking device that is mounted on the housing and completely within the cylinder defined by the outer surface and that prevents rotation of the cylinder body with respect to the housing in the absence of an appropriate electronic credential, and allows the rotation with respect to the housing of the rotating member and the cylinder body together with the tailpiece upon the presentation of an appropriate electronic credential and in the absence of an appropriate key, and in response to rotation of the turnpiece, a second locking device that prevents rotation of the rotating member with respect to the cylinder body in the absence of an appropriate key, and allows rotation of the rotating member and the tailpiece with respect to the cylinder body when an appropriate key is inserted in the key receptacle and either the turnpiece or the key is turned; and wherein the rotating member and the cylinder body are not movable in the axial direction.

18. The door lock of claim 17, wherein the second axis is the same as the first axis.

19. The door lock of claim 18, wherein the tailpiece is movable from a locked position to an unlocked position, and wherein the orientation of the tailpiece with respect to the first axis in the locked position is different than the orientation of tailpiece with respect to the first axis in the unlocked position.

20. The door lock of claim 17, wherein the portion of the rotating member located within the cylinder body is generally cylindrical.

21. The door lock of claim 17, wherein the cylinder body is configured to partially house the second locking device.

22. The door lock of claim 21, wherein the second locking device includes pin pairs extendable in a radial direction of the rotating member from a groove in the rotating member to a pin constraining portion of the cylinder body.

23. The door lock of claim 17, wherein the first locking device includes a locking member movable from a first position to a second position, wherein at the first position, the locking member prevents rotation of the cylinder body with respect to the housing and at the second position, the locking member allows rotation of the cylinder body.

24. The door lock of claim 23, wherein the first locking device includes an electronic device reactive to the presentation of an appropriate electronic credential, wherein the electronic device includes an actuator for moving the locking member from the first position to the second position upon the presentation of an appropriate electronic credential.

25. The door lock of claim 24, wherein the locking member is engaged in a slot of the cylinder body in the first position and is disengaged from the slot in the second position.

26. The door lock of claim 25, wherein the locking member is moved outwardly in a radial direction from the slot to disengage the locking member.

27. The door lock of claim 17, wherein the first locking device includes a locking member, and an electronic device reactive to the presentation of an appropriate electronic credential, and wherein the electronic device includes an actuator for moving the locking member upon the presentation of an appropriate electronic credential.

28. The door lock of claim 17, wherein the rotating member includes one of a notch and a pin, and the turnpiece includes the other of the notch and the pin, and wherein the pin is engaged with the notch.

29. The door lock of claim 28, wherein the engagement of the pin with the notch is configured to allow rotation of the rotating member with respect to the cylinder body in response to the insertion of the appropriate key into the key receptacle.

30. The door lock of claim 28, wherein the engagement of the pin with the notch is configured to allow rotation of the rotating member and the cylinder body with respect to the housing in response to the presentation of the appropriate electronic credential.

* * * * *